United States Patent [19]

Walker

[11] Patent Number: 4,655,351

[45] Date of Patent: Apr. 7, 1987

[54] WALL RACK APPARATUS

[76] Inventor: Pamela Walker, 1834 E. Ball Rd., Anaheim, Calif. 92805

[21] Appl. No.: 848,777

[22] Filed: Apr. 7, 1986

[51] Int. Cl.[4] ..... A47F 5/08

[52] U.S. Cl. ..... 211/88; 211/181

[58] Field of Search ..... 211/88, 4, 6, 90, 181; 248/915, 916, 249, 558; 403/405.1, 406.1, 375

[56] References Cited

U.S. PATENT DOCUMENTS

| | | | |
|---|---|---|---|
| 824,333 | 6/1906 | Bassick | 211/4 X |
| 1,238,637 | 8/1917 | Clark | 248/249 X |
| 1,500,487 | 7/1924 | Carlin | 248/249 X |
| 2,225,681 | 12/1940 | Braun | 211/181 X |
| 4,008,808 | 2/1977 | Ramsay | 211/88 X |
| 4,234,094 | 11/1980 | Jorgensen | 211/88 |
| 4,437,639 | 3/1984 | Stein | 248/558 |

FOREIGN PATENT DOCUMENTS

| | | | |
|---|---|---|---|
| 579897 | 9/1976 | Switzerland | 211/88 |
| 1540119 | 2/1979 | United Kingdom | 248/915 |

*Primary Examiner*—J. Franklin Foss
*Assistant Examiner*—Sarah A. Lechok Eley
*Attorney, Agent, or Firm*—Gary Appel

[57] ABSTRACT

Wall rack apparatus comprises a frame bent from a tube or rod to have at least one inverted U-shaped opening into which is received portions of a mounting member. A flange on the mounting member and at least one key formed on the mounting member, and a corresponding keyway or keyways formed into the frame adjacent the inverted U-shaped opening, non-rotatably retain the frame and mounting member together when the mounting member is attached, as with screws, to a mounting surface. A recess is formed into U-mounting member, the mounting screws being installed through the bottom of the recess. A cap is provided for plugging the recess, a detent being provided to releasably retain the cap in the recess.

14 Claims, 5 Drawing Figures

FIG. 1
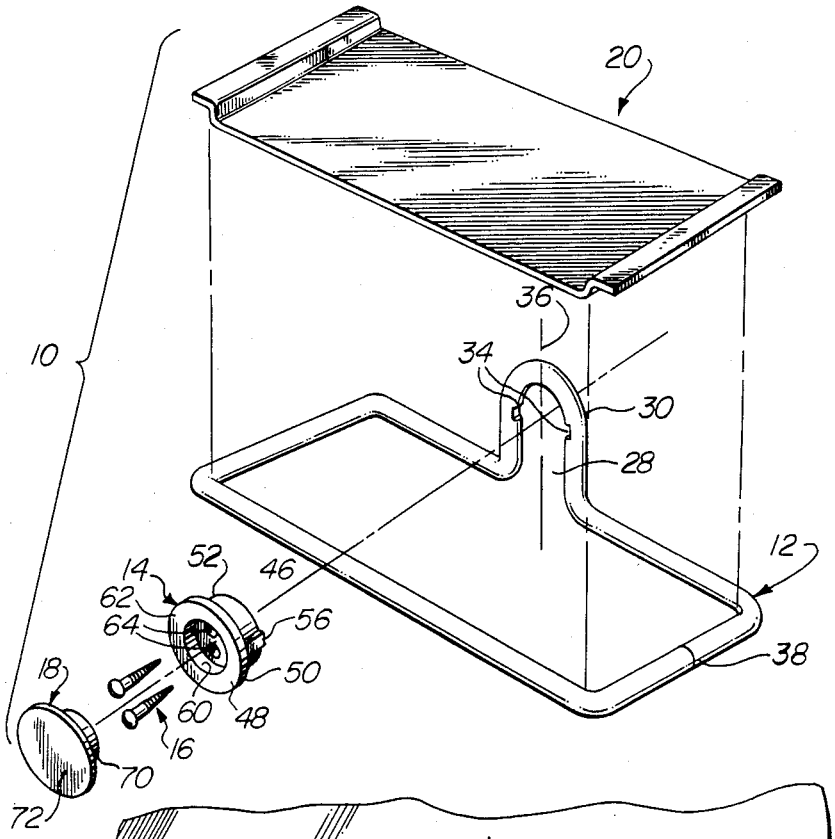
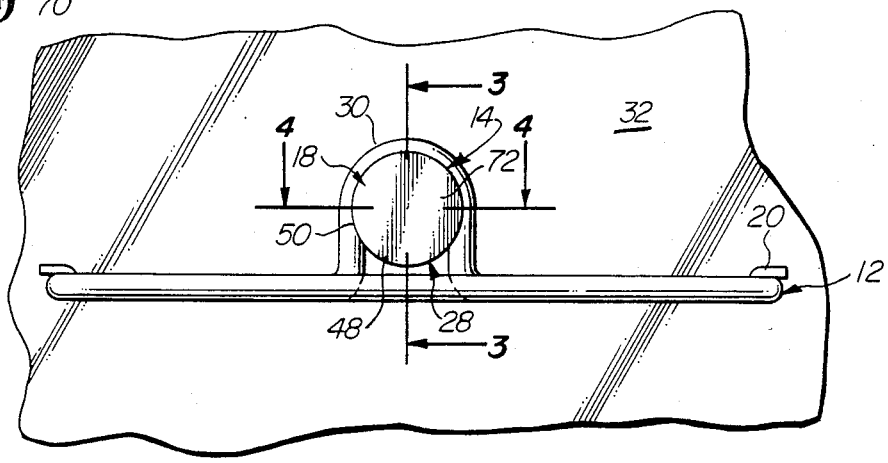
FIG. 2

WALL RACK APPARATUS

BACKGROUND OF THE INVENTION

1. Field of the Invention

The present invention relates generally to the field of wall-mounted racks, such as wall-mounted towel racks, toilet tissue dispensers and water glass, soap dish and toothbrush holders.

2. Discussion of the Prior Art

Almost an endless variety of wall-mounted racks for holding various different objects have been or are being provided to home owners, apartment dwellers and institutions. The great variety of such wall-mounted racks, which are available, testifies to the ever changing tastes of the general public with respect to appearance and utility in their living quarters of common-place objects including towel racks, toilet tissue dispensers, soap holders, toothbrush holders and so forth.

In general, however, most purchasers of wall-mounted racks require sturdiness, attractiveness, convenience of installation and use and, as a rule, comparatively low cost. Various deficiencies are commonly associated with available wall-mounted racks of the bathroom and kitchen types. Many such racks are flimsy in construction, others are difficult to mount on walls, and still others are too expensive.

For these and other reasons, improvements in wall-mounted racks are continually sought and improved racks can be commercially successful.

It is, therefore, an object of the present invention to provide a wall mounted rack which combines the features of comparatively low cost, sturdiness, utility and attractiveness. Other objects, features and advantages of the present invention will be apparent from the following detailed description.

SUMMARY OF THE INVENTION

Wall rack apparatus, according to the present invention, comprises an open article holding frame having means defining at least one inverted U-shaped opening in regions of the frame which contact a surface to which the frame is to be mounted and a mounting member shaped to fit into such frame opening. The mounting member has an outer frame retaining flange around at least portions of the periphery thereof and has at least one peripherally located key sized to fit into a mating keyway formed into the frame. The key and keyway are shaped and located so as to non-rotatably retain the frame to the mounting member together, when the mounting member is attached to the mounting surface, means being included for attaching the mounting member to such surface.

Preferably, two keys are provided on the mounting member in an opposing relationship on opposite side edges of the member, two mating keyways being formed in the frame adjacent to the inverted U-shaped opening.

According to a preferred embodiment, a recess is formed into the mounting member in a region of one or more mounting apertures.

A cap is then provided for plugging the recess, and thereby hiding the mounting screws. A protruding portion of the cap which fits into the mounting member recess being retained therein by detent means which include a protrusion formed as either the or into the mounting member recess and a mating, protrusion-receiving recess formed into the other area of the cap and mounting member.

BRIEF DESCRIPTION OF THE DRAWINGS

A better understanding of the present invention may be had from a consideration of the following detailed description, taken in conjunction with the accompanying drawings in which:

FIG. 1 is an exploded perspective drawing of a wall fixture apparatus in accordance with the present invention, showing the various parts of the apparatus;

FIG. 2 is a front elevational view of the assembled apparatus of FIG. 1, showing the apparatus attached to a wall;

DESCRIPTION OF THE PREFERRED EMBODIMENT

Figure 3:
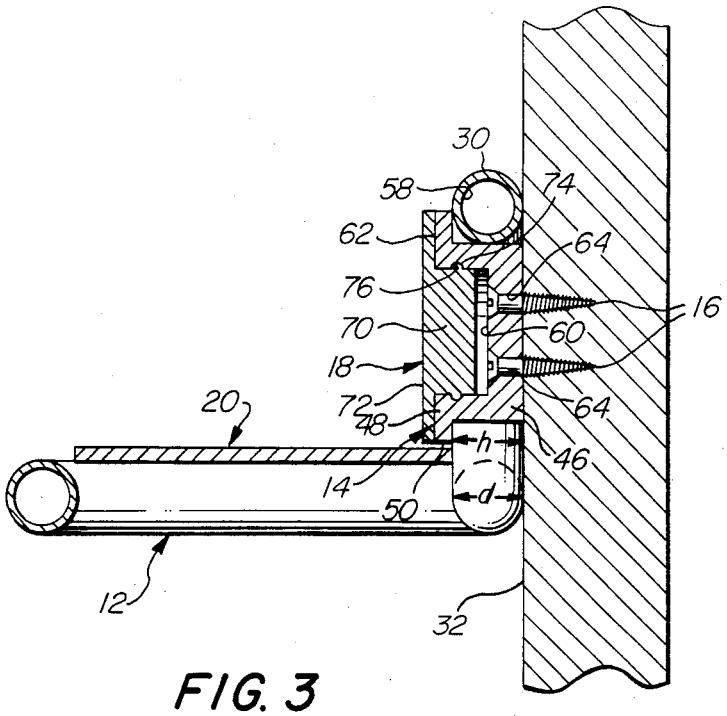
FIG. 3 is a vertical cross sectional view taken along line 3—3 of FIG. 2, showing the manner in which the apparatus is assembled.

As shown in FIG. 1, a wall rack apparatus 10 comprises generally an open, article holding frame 12 and a frame mounting member 14. Also included in apparatus 10 are mounting screws 16 and a decorative cap 18. By way of example, frame 12 is shown to be configured at right angles to hold or support a small tray 20, upon which such items as combs, hair brushes and the like (not shown) may be stored between use. It is, however, to be appreciated that frame 12 may alternatively be configured in various other shapes, as will be apparent to those skilled in the art, to hold objects other than tray 20. Thus, for example, frame 12 may alternatively be shaped to hold a drinking glass, towels, face cloth, toothbrush holders, toilet tissue rolls or so forth.

Frame 12 is, in any event, formed so as to define at least one inverted U-shaped, open mounting region 28. As shown, mounting region 28 is generally rectangular in shape but may, alternatively, be formed to be square, round, oval, elliptical, some circular, or any other desired shape. Open region 28 is as shown, defined or bounded by a flat, inverted U-shaped frame portion 30 which is intended to lay flat against a surface 32 (FIGS. 2–4) to which apparatus 10 is mounted.

Figure 4:
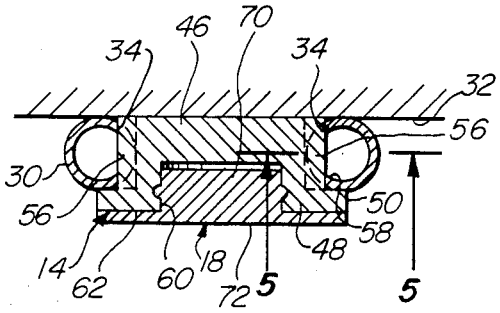
FIG. 4 is a transverse cross sectional view taken along line 4—4 of FIG. 2 showing the keying together of frame and mounting portions of the apparatus.

Formed or notched into frame portion 30 is at least one keyway 34, there being shown two such keyways in FIGS. 1 and 4. When two keyways 34, such as are shown, are used, they preferably face one another and are symmetrically located with respect to a vertical centerline 36 through opening 28 (FIG. 1). Preferably frame 12 is constructed from a tube (as shown) or a rod which is bent into the desired shape, the ends of the tube or rod being joined together, at a location 38, as by butt welding, if the tube or rod is metal or as by cementing if the tube or rod is of a plastic material.

Mounting member 14 is constructed, for example, of plastic and has a generally rectangular body portion 46 and a head portion 48 defined by a peripheral flange 50 (FIGS. 1 and 3–4). Body portion 46 is sized to closely fit into frame opening 28 and is preferably rounded at corners 52 (FIG. 1) to match the bend radius of frame portion 30, a snug fit of the body portion into the frame opening being thereby provided. The height, h, of body portion 46 (FIG. 3) is preferably about equal to or slightly less than the cross sectional diameter, d, of frame 12 in the region of opening 28.

Figure 5:
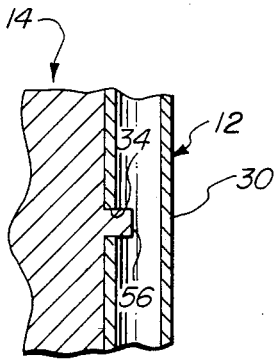
FIG. 5 is a cross sectional view taken along line 5—5 of FIG. 4 showing additional features of the frame and mounting portions of the apparatus.

Projecting outwardly from opposite side edges of mounting member body portion 46 are keys 56 (FIG. 1, 4 and 5), which are shaped to fit into keyways 34 notched into frame portion 30 when the body portion is inserted into opening 28. The fitting of body portion keys 56 into frame portion keyways 34, upon assembly of apparatus 10 and when the apparatus is mounted, by screws 16, to mounting surface 32, locks mounting member 14 and frame 12 together so that the frame cannot be separated from the mounting member until the apparatus is unmounted from surface 32. In this regard, flange 50 which preferably extends all around mounting member head portion 48 and, in fact, defines such head portion, extends outwardly over adjacent regions of frame portion 30 when mounting member body portion 46 is inserted into frame opening 28. Thus, when apparatus 10 is assembled in the above-described manner, frame portion 30 is retained between an under surface 58 of flange 50 and mounting surface 32 (FIGS. 3 and 4). Although use of two keys 56 and keyways 34 are shown, it is to be appreciated only one key and keyway may often suffice.

For appearance purposes, a recess 60 is preferably formed into mounting member 14 from a forward surface 62 thereof (FIGS. 1, 3 and 4). At least one screw mounting aperture 64 (two, however, being shown in FIGS. 1 and 3) is formed through member 14 in the region of the recess so that mounting screw or screws 16 are correspondingly recessed when inserted through such apertures 64 and are tightened to attach the member and hence apparatus 10 to surface 32.

Cap 18 is provided to conceal screws 16 after apparatus 10 is mounted to surface 32. Cap 18 is formed, for example, of plastic to have a projecting portion 70 which snugly fits into mounting member recess 60, or alternatively is secured to flange 50. A head portion 72 of cap 18 extends sidewardly portion 70 and upon installation, peripheral edge regions thereof covers regions of mounting member surface 62 around recess 60. Although cap 18 may be configured so that projecting portion 72 thereof is retained in mounting member recess 60 by a press fit of the cap into the recess, it is preferred that detent means be provided to assure positive retention of the cap in the recess or alternatively to flange 50. Such detent means may, as shown in FIGS. 3 and 4, comprise a protruding head 74 formed all or part way around the outside of the cap projecting portion 70 and a mating groove or recess 76 formed all or part way around recess 60. Thus, when cap 18 is installed into recess 60, bead 74 snaps into groove 76 to releasably attach the cap to mounting member 14. Alternatively a bead may be formed around recess 60 in which a mating groove is formed around cap projecting portion 70 (in a manner not shown). If the cap is configured so as to be secured to flange 50, bead 74 and mating groove 76 are properly located to releaseably attach the cap 18 to flange 50.

It can be appreciated that although frame 12, as above described and as shown in the drawings, includes only one inverted U-shaped opening 28 for receiving mounting member 14, only one of which is therefore required, such is not necessarily the case and the invention is not limited thereto. Thus, as an example, a long rack frame suitable for hanging bath towels, may be provided with two (or more) inverted U-shaped openings corresponding to above-described opening 28, two (or more) mounting members 14, with mounting screws 16 and cap 18, being therefore also used.

Therefore, although there has been described above a specific arrangement of a wall rack apparatus in accordance with the present invention for purposes of illustrating the manner in which the invention may be used to advantage, it will be appreciated that the invention is not limited thereto. Accordingly, any and all modifications or variations which may occur to those silled in the art should be considered to be within the spirit and scope of the invention as defined in the appended claims.

What is claimed is:

1. Wall rack apparatus which comprises:

a. an open article holding frame having means defining at least one inverted, U-shaped opening in regions of the frame which contact a surface to which the frame is to be mounted;

b. a mounting member shaped to fit into said inverted U-shaped opening of the frame, said member having an outer, frame retaining flange around at least portions of the periphery thereof and having at least one peripherally located key, sized to fit into a mating keyway formed in the frame, said key and keyway being shaped to non-rotatably retain said frame to said mounting member when the mounting member is inserted into said opening and the member is attached to said mounting surface; and, c. means for attaching said mounting member to said mounting surface.

2. The apparatus as claimed in claim 1 wherein said mounting member has opposed, first and second keys located on opposite side edges thereof, the frame having corresponding first and second keyways adjacent to said inverted U-shaped opening.

3. The apparatus as claimed in claim 1 wherein said frame comprises a bent rod.

4. The apparatus as claimed in claim 1 wherein said frame comprises a bent tube.

5. The apparatus as claimed in claim 1 wherein said mounting member has wall means defining a recess in an outer face thereof, said mounting means including at least one aperture formed through the mounting member in the region of said recess, said aperture being sized to receive a conventional screw or the like.

6. The apparatus as claimed in claim 5 including a decorative cap having a region sized to closely fit into said recess, the recess being then covered by the cap.

7. The apparatus as claimed in claim 6 including means for releasably retaining said cap in said recess.

8. The apparatus as claimed in claim 7 wherein said retaining means includes a protrusion formed on one of the cap and mounting member and a mating recess formed on the other of the cap and mounting member.

9. Wall rack apparatus which comprises;

a. an open, article-holding frame formed to have at least one U-shaped mounting opening in regions of the frame which contact a surface to which the apparatus is to be mounted, said frame having at least one keyway defined therein in the region of said inverted U-shaped opening; and b. a mounting member having a body sized to fit into said inverted U-shaped opening of the frame, said body having a sidewardly projecting key sized and located to fit within the frame keyway when the mounting member body is mounted into said inverted U-shaped opening, the key and keyway preventing relative rotational movement between the frame and the mounting member, said member having a retaining flange formed at least partially around said body so that when the body is inserted into said inverted U-shaped opening and is attached to a mounting surface, the frame cannot be detached from the mounting member.

10. The apparatus as claimed in claim 9 wherein the mounting member is formed having at least one mounting aperture in the body thereof.

11. The apparatus as claimed in claim 10 where the region of said body around the mounting aperture is recessed and including a cap having a portion thereof sized to fit into said recessed region so as to cover the mounting aperture.

12. The apparatus as claimed in claim 11 including detent means for releasably connecting the bezel cap to the mounting member.

13. The apparatus as claimed in claim 10 including a bezel cap configured to fit over the flange portion of said mounting member so as to cover the mounting aperture and sized to fit securely to said flange portion.

14. The apparatus as claimed in claim 13 including detent means for releasably connecting the cap to said flange portion of said mounting member.

* * * * *